United States Patent [19]

Jones et al.

[11] Patent Number: 4,660,455

[45] Date of Patent: Apr. 28, 1987

[54] MUSICAL PERCUSSION INSTRUMENT CONSTRUCTION

[75] Inventors: Jonathan R. Jones, Granville, Mass.; Robert A. Gatzen, Newington, Conn.

[73] Assignee: Noble & Cooley Co., Granville, Mass.

[21] Appl. No.: 913,970

[22] Filed: Oct. 1, 1986

[51] Int. Cl.[4] ..... G10D 13/02

[52] U.S. Cl. ..... 84/413; 84/411 R

[58] Field of Search ..... 84/411–420

[56] References Cited

U.S. PATENT DOCUMENTS

| | | | |
|---|---|---|---|
| 663,855 | 12/1900 | Boulanger | 84/411 R |
| 794,658 | 7/1905 | Boulanger | 84/411 R |
| 1,121,909 | 12/1914 | Elkins et al. | 84/411 R |
| 2,173,443 | 9/1939 | Schuman | 84/411 A |
| 4,295,405 | 10/1981 | Sleishman | 84/413 |
| 4,334,458 | 6/1982 | Grauso | 84/411 R |

*Primary Examiner*—Lawrence R. Franklin

*Attorney, Agent, or Firm*—Chapin, Neal & Dempsey

[57] ABSTRACT

Musical percussion instrument of the drum type includes tensioning rods fitted at circumferentially spaced locations about the periphery of the drum. The drum includes a cylindrical shell with metallic rims fitted onto the outer edge of the shell. Each rod has a tubular central portion and threaded bolts screw-fitted into the outer end of the tubular portion. The outer ends of the rods are received by brackets which extend outwardly from each of the rims in circumferentially registered relation. A support post extends radially outward from the shell of the drum at a location corresponding to each tensioning rod and the outer end of the post engages the rod to brace the same. Each post is affixed to the shell at a vibratory nodal point which, as measured from the adjacent end of the shell, is approximately one-fifth the overall height of the shell.

7 Claims, 2 Drawing Figures

MUSICAL PERCUSSION INSTRUMENT CONSTRUCTION

BACKGROUND OF THE INVENTION

This invention relates to tensioning devices for drum type percussion instruments and more particular to the use of tensioning rod support posts located at approximately the nodal point of the drum shell.

The art of manufacturing percussion instruments of the drum type dates back hundreds of years and some examples of drums with tensioning or tightening devices are shown in the following U.S. Pat. Nos.: 578,198; 635,856; 663,855; 794,658; 1,014,109; 1,042,806; 1,121,909; 1,443,191; 1,648,212; 2,132,105; 2,173,443. A review of these patents shows various types of tensioning rods with support posts extending from the periphery of the drum to engage and support the axially extending rods at one or more spaced locations along the length of each rod. In some cases, such as in U.S. Pat. Nos. 794,658 and 1,014,109, there is one post for each rod and it is located at the midpoint of the rod.

In other of these patents, such as U.S. Pat. Nos. 663,855 and 1,121,909, there are two posts for each rod and each is located an equal distance from the upper and lower edge of the drum shell.

Unlike the prior art construction, this invention utilizes at least one support post for each rod and the post is disposed at the vibratory nodal point of the drum shell which is at a distance of approximately one-fifth (1/5) the overall height of the drum shell measured from the adjacent edge of the drum. Where only one such support post is used, it is located at the vibratory nodal point adjacent the lower end of the drum.

The principal object of this invention is to provide an improved drum having constructional features which do not affect the harmonic vibrations of the drum shell caused by the striking of the batter head.

Figure 1:
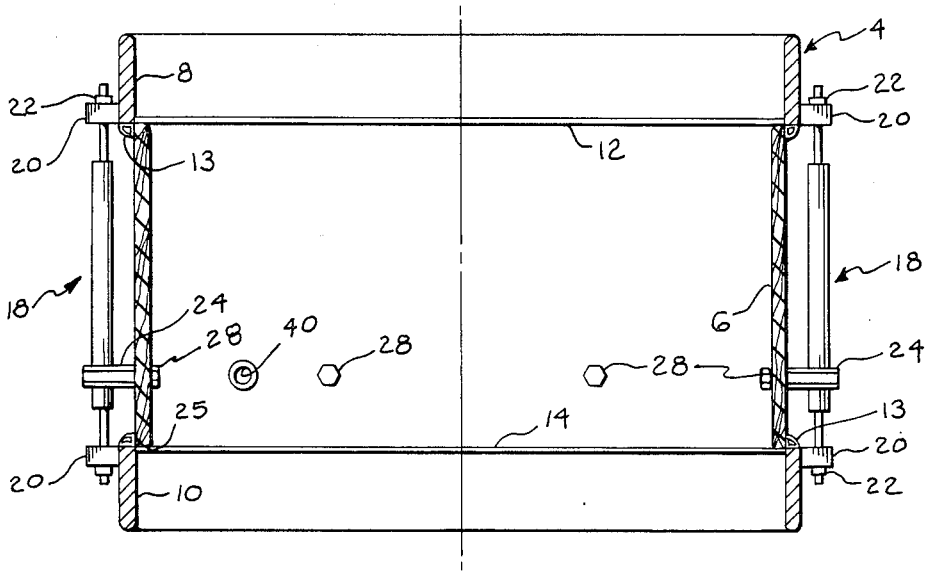
Figure 2:
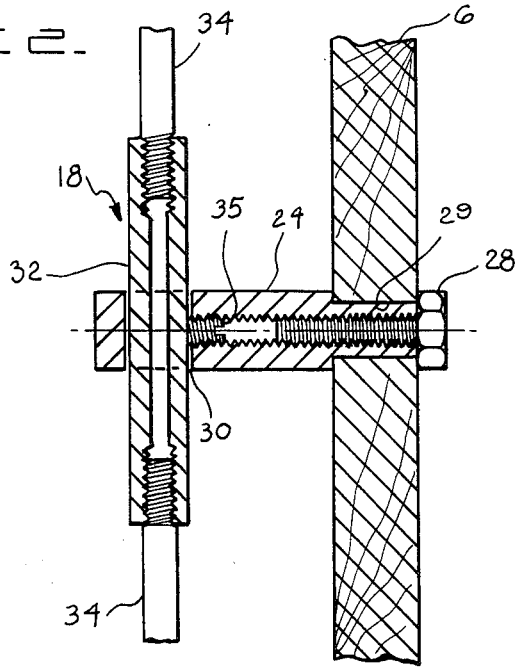

The above and other objects and advantages of this invention will be more readily apparent from the following description read in conjunction with the accompanying drawing in which:

FIG. 1 is an elevational view in cross-section showing one type of drum embodying this invention, and FIG. 2 is an enlarged cross-sectional view of a portion of the drum shown in FIG. 1.

Referring in detail to the drawing, a drum is shown generally at 4 in FIG. 2. The drum comprises an integrally formed cylindrical shell 6 fabricated of wood, such as rock maple or other suitable material. Upper and lower metallic rims 8 and 10 are fitted onto the opposite ends of the shell and the rims serve to retain and tension the batter head 12 and lower head 14 of the drum in proper tensioned relationship across the opposite ends of the shell. The outer edges of these heads or membranes are folded about rings or hoops 13 which are adapted to fit closely over the outer edges of the shell. The inner edges of the rims 8 and 10 engage the portions of the drum heads disposed about the hoops 13 for tensioning the heads for the desired pitch.

Tensioning rods, shown generally at 18 in FIG. 1, are disposed at circumferentially spaced locations about the periphery of the drum. The outer end portions of the tensioning rods are fitted through brackets or fittings 20 formed on the rims 8 and 10 at corresponding points for a vertical registration, as shown in FIG. 1. As shown, the outer portions of these rods are in the form of shouldered bolts with a hexagonal head portion 22 for adjusting the tension of the rods 18 which is transmitted to the rims 8 and 10 by the brackets 20 which extend radially outward of the rims.

In the illustrated embodiment, each tensioning rod 18 is braced in a radial direction by a standoff post or lug 24 which extends radially from the shell 6 at a point approximately one-fifth (1/5) the overall height of the shell as measured from the lower edge of the shell. For snare and tom-tom type drums, the radial posts 24 are disposed adjacent the lower edge of the shell.

For larger size drums, such as bass drums, two such standoff posts 24 would be provided on each rod and each post would be located at a distance measured from the adjacent edge of the shell approximately one-fifth (1/5) the overall height of the shell.

As best illustrated in FIG. 2, each post 24 comprises an internally threaded hollow or tubular hexagonal lug adapted to receive therein a correspondingly threaded bolt 28. The post 24 includes an inner end portion of reduced diameter which is adapted to fit snugly through a hole 29 provided through the wall of the shell 6. The head of the bolt 28 is disposed within the shell and its shank portion is screwed into the sleeve 24. Adjacent its outer end, the post or lug 24 is provided with a transverse hole 30 adapted to receive therethrough a tubular rod 32 which is internally threaded at its outer ends for screw-fitting engagement with the lower ends of the threaded shoulder bolts 34. A small setscrew 35 is disposed within the threaded bore of the post 24 and its outer end is adapted to engage the outer surface of the tubular rod 32 to hold the same in fixed position relative to the post. After tightening the setscrew 35, the threaded shank portion of the bolt 28 is screwed into the bore of the post 24 to firmly anchor the post radially of the shell 6. Tensioning of the drum heads is accomplished by adjusting the bolts 34, using a suitable tool for drivingly engaging the bolt heads 22 which abut the outer surface of the brackets 20. The bolts are thus screwed into or out of the tubular rod 32 to adjust the tension of rods 18.

In accordance with this invention, the posts 24 are disposed at a vibratory nodal point of the shell which are spaced from the edges of the drum at approximately one-fifth (1/5) the overall height of the shell. Thus, for example, for a shell of 10-inches in height, the nodal points would occur at distances measured 2-inches from each end of the shell. Preferably, the standoff posts are mounted 2-inches from the lower edge of the shell whereby the vibratory resonance is optimized by having no impediment to its free vibration until adjacent the shell's lower edge. For bass drums, each rod is braced by two posts, one at the nodal points adjacent each end of the shell. By mounting the posts at these locations, it has been found that there is minimum attenuation or dampening of the natural or inherent vibratory resonance of the wooden shell. In this way, the drum has been found to possess a more full-bodied sound. Moreover, by mounting the support posts adjacent only the lower edge of the shell, optimum resonance is achieved because the entire upper four-fifths (4/5) area of the shell is free of any openings or connecting structures. Thus, the major portion of the shell is available for full and unimpeded sonic vibration. In addition, vent port 40 is also bottom-mounted so that the entire air column is free to resonate within the drum before venting. The vent port 40 comprises a metal grommet reinforced hole provided through the shell at the same nodal point location as the posts 24.

Another feature of this invention is the use of tubular posts or lugs by which a large strength-to-weight ratio is achieved. With this arrangement, there is provided a strong lightweight drum structure in which the support posts do not adversely affect the inherent or natural resonance of the wooden drum shell.

Having thus described our inventon, what is claimed is:

1. Musical percussion instrument comprising a cylindrical shell, a batter head disposed across one end of said shell and tensioned by means including metallic rims fitted onto the outer edges of said shell, axially extending tensioning rods disposed in circumferentially spaced relation about said shell and connected adjacent their opposite ends to each of said rims, each tensioning rod being braced by a radially extending post member affixed to said shell at a point corresponding to the vibratory nodal point of said shell located adjacent the end of said shell opposite said batter head.

2. Musical percussion instrument as set forth in claim 1, in which said nodal point is located approximately one-fifth (1/5) the overall height of said shell measured from the adjacent end of said shell.

3. Musical percussion instrument as set forth in claim 2, in which each of said post members is a tubular lug which extends through a hole provided in said shell.

4. Musical percussion instrument as set forth in claim 3, in which each said tensioning rod comprises a tubular medial portion having internally threaded outer end portions with bolts screw-fitted into the outer end portions of the tubular portion, each of said post having a transverse hole which receives said medial portion, and a setscrew disposed within said tubular post and engaged with said medial portion to fasten the same in fixed position relative to said post.

5. Musical percussion instrument as set forth in claim 4, in which said shell includes a vent port disposed at the same height as said support member adjacent the end of said drum opposite said batter head.

6. Musical percussion instrument as set forth in claim 4, in which each of said tubular post has an internally threaded bore and includes an end portion of reduced diameter which fits snugly into the hole in said shell, a bolt fitted into said bore from within said shell.

7. Musical percussion instrument as set forth in claim 2, in which each tensioning rod is supported by a pair of post members, each post member being disposed at the vibratory nodal point of said drum which is located at a distance measured from the adjacent end of said shell approximately equal to one-fifth (1/5) the overall height of said shell.

* * * * *